US005921648A

United States Patent [19]

Rong

[11] Patent Number: 5,921,648

[45] Date of Patent: Jul. 13, 1999

[54] DRAWER ASSEMBLY FOR A STORAGE BIN

[76] Inventor: Liu Ching Rong, No. 10, Sung-Chiang N. Rd., Chung-Li, Taiwan

[21] Appl. No.: 09/001,462

[22] Filed: Dec. 31, 1997

[51] Int. Cl.[6] ..... A47B 88/00

[52] U.S. Cl. ..... 312/348.4; 312/263; 312/265.6

[58] Field of Search ..... 312/348.4, 265.5, 312/265.6, 263, 257.1, 403

[56] References Cited

U.S. PATENT DOCUMENTS

| | | | |
|---|---|---|---|
| 3,179,480 | 4/1965 | Brinker | 312/348.4 |
| 4,482,074 | 11/1984 | Lalley | 312/265.5 X |
| 4,732,430 | 3/1988 | Byrns | 312/348.4 X |
| 5,197,789 | 3/1993 | Lin | 312/265.5 X |
| 5,423,605 | 6/1995 | Liu | 312/265.6 |
| 5,735,411 | 4/1998 | Flamme et al. | 312/223.1 X |

*Primary Examiner*—Peter M. Cuomo
*Assistant Examiner*—Stephen Vu
*Attorney, Agent, or Firm*—Bacon & Thomas, PLLC

[57] ABSTRACT

A drawer combination of a storage bin which is convenient and firm in assembling and the life of use thereof is increased, it is comprised of an injection moulded plastic container and a front panel. The front side of the container is opened and is provided with a plurality of engaging pieces, a gripping edge, a grip, a plurality of engaging holes, two connecting edges and two engaging grooves. The-front panel is provided with a plurality of engaging holes, recess chamber, an opening, an engaging edge, a plurality of locking hooks, two abutting edges and two engaging hooks, in order to be connected to the front side of the containers. A user can extend his hand into the groove to hold the grip through the opening, so the force exerted on the grip can be distributed through the engaging structure to the whole front edge of the container, thereby preventing damage to the grip.

1 Claim, 3 Drawing Sheets

DRAWER ASSEMBLY FOR A STORAGE BIN

BACKGROUND OF THE INVENTION

1. Field of the Invention

The present invention relates to a drawer combination of a storage bin, the drawer is comprised of an injection moulded container and an injection moulded front panel, they can be firmly engaged with each other easily. When in use, force does not exert directly on the engaging structure, so that effects of convenient transportation as well as firm construction can be attained.

2. Description of the Prior Art

A Plastic storage bin of the earlier days is comprised structurally of a container and an upper lid injection moulded individually, when in use, the lid is lifted to allow the container to store clothes, tools, or the articles of every day use etc., and then the container is covered with the lid again, and the articles can be well stored. Such a conventional plastic storage bin is used singly, it is not so useful in saving space of a room. Therefore, there have been storage bins developed to allow the drawers thereof to be stacked one over another, a room space thus can have an excellent utilization.

One of the above stated conventional stackable storage bin, as is shown in FIG. 1, is comprised of a supporting shelf 1 including a plurality of layers and comprised of a plurality of drawers 2, in which, the drawers 2 each has its side plates which form therein a receiving space for receiving articles, and can be inserted into the divided spaces in layers to resemble a wardrobe for saving a room space, such a storage bin has the advantages of being easy to be assembled and dismantled as well as costing low.

However, such a conventional storage bin still has the disadvantages which are mainly induced from the fact that the drawers 2 are integrally injection moulded, when they are shaped, the top front edge of each of them extends forwardly in the first and then is bent inwardly to form a pulling lever 21, after the drawers 2 are stored with articles, and when a user pulls one pulling lever 21 outwardly, force exerted thereon is completely borne by the thinner front edge thereof, the pulling lever 21 is therefore subjected to damage.

SUMMARY OF THE INVENTION

In view of this, the present invention has overcome the following problems.

1. If another pulling knob is provided on the front surface and is fixed in assembling, assembling thereof is troublesome due to using of screws, and when in pulling, pulling force is borne by the screws and the front knob wherein bearing of the force is in a point contact mode, the drawer is subjected to damage.

2. If the bottom end of such a drawer is provided with a recess near the front edge thereof by injection moulding, when the drawer is inserted into the supporting shelf, the recess will be hindered by another drawer beneath the former drawer, hence a user is not able to access the recess.

3. If a recess is provided and declined from the lower end to the upper end thereof on the front surface of the drawer, it seems to be helpful structurally in solving the problems. However, the drawer is integrally injection moulded, it is impossible to obtain such a structure by injection moulding as desired.

4. If a protruding knob is integrally provided by injection moulding on the front surface of the drawer, this can also structurally be helpful structurally in solving the problem of being subjected to damage, and this can be achieved by injection moulding. However, the knob will render the drawers made by injection moulding unable to be stacked one over another, and inconvenience may be induced in storing and shipping.

Accordingly, the inventor provides the structure of a drawer combination of a storage bin of the present invention after continuous study and improvement, the drawer combination is comprised of an injection moulded container and an injection moulded front panel, wherein:

The container is provided with a horizontal bottom plate, two vertical lateral plates and a rear vertical stop plate, the front thereof is opened, the bottom plate is provided with a plurality of engaging pieces beneath the front edge thereof and extending downwardly and spacing mutually, the front edge is provided thereon with a gripping edge which is recessed on the bottom thereof and forms a protruding grip on the top, and the top of the protruding grip is provided with a plurality of engaging holes; the two lateral plates extend forwardly respectively to form two connecting edges which both join the gripping edge on the bottom ends thereof and are provided each with an engaging groove on the top ends thereof.

The front panel is made in the shape of a sheet, can be assembled on the front side of the container and is provided with four edges extending inwardly of which the bottom edge is provided with a plurality of engaging holes corresponding respectively to the engaging pieces of the container, the front panel is provided further with a groove above the bottom edge, the front panel is therefore convex, the groove is located exactly beneath the gripping edge, an opening is provided in the groove at the postition corresponding to the grip of the gripping edge, when a user extends his hand into the groove of the front panel, he can hold the grip through the opening; an engaging edge is provided above the groove of the front panel, which engaging edge is located exactly above the grip after assembling, a plurality of locking hooks are provided corresponding respectively to the engaging holes on the top of the grip, the engaging edge is provided on each end thereof with an abutting edge extending upwardly therefrom and can abut against the connecting edges in the front of the container, the tops of the abutting edges are provided each with an engaging hook corresponding respectively to the abovementioned engaging grooves, so that the front panel can be firmly connected with the container.

The structure of the drawer of the present invention is provided with the following advantages:

1. The front panel and the container can be injection moulded separately in manufacturing, when in assembling of them, it only needs to have the front panel abutted against the front end of the container, they can be combined only by a pressing force, thereby working time can be reduced.

2. When in completion of manufacturing, a plurality of containers and front panels can be stacked one over another for packaging, thus is beneficial to shipping and storing, and users can assembly them by themselves.

3. When in use, force is exerted on the front end of the container, and is distributed through the above stated engaging members, the grip is not damaged thereby, so that the life of use thereof can be increased.

4. When in assembling, the front panel is abutted against the front end of the container, the bottom end thereof is connected by engaging of the engaging holes on the abovementioned bottom edge with the engaging pieces; the middle portion thereof is connected by engaging of the engaging holes on the top of the protruding grip with the locking hooks, the abutting edges now abut against the connecting edges in the front of the container; the top end thereof is connected by engaging of the engaging hooks with the engaging grooves, so that the front panel can be firmly connected with the container.

The present invention will be apparent in its practical structural characteristics from the detailed description of the preferred embodiment thereof in reference to the accompanying drawings.

DETAILED DESCRIPTION OF THE PREFERRED EMBODIMENT

Figure 1:
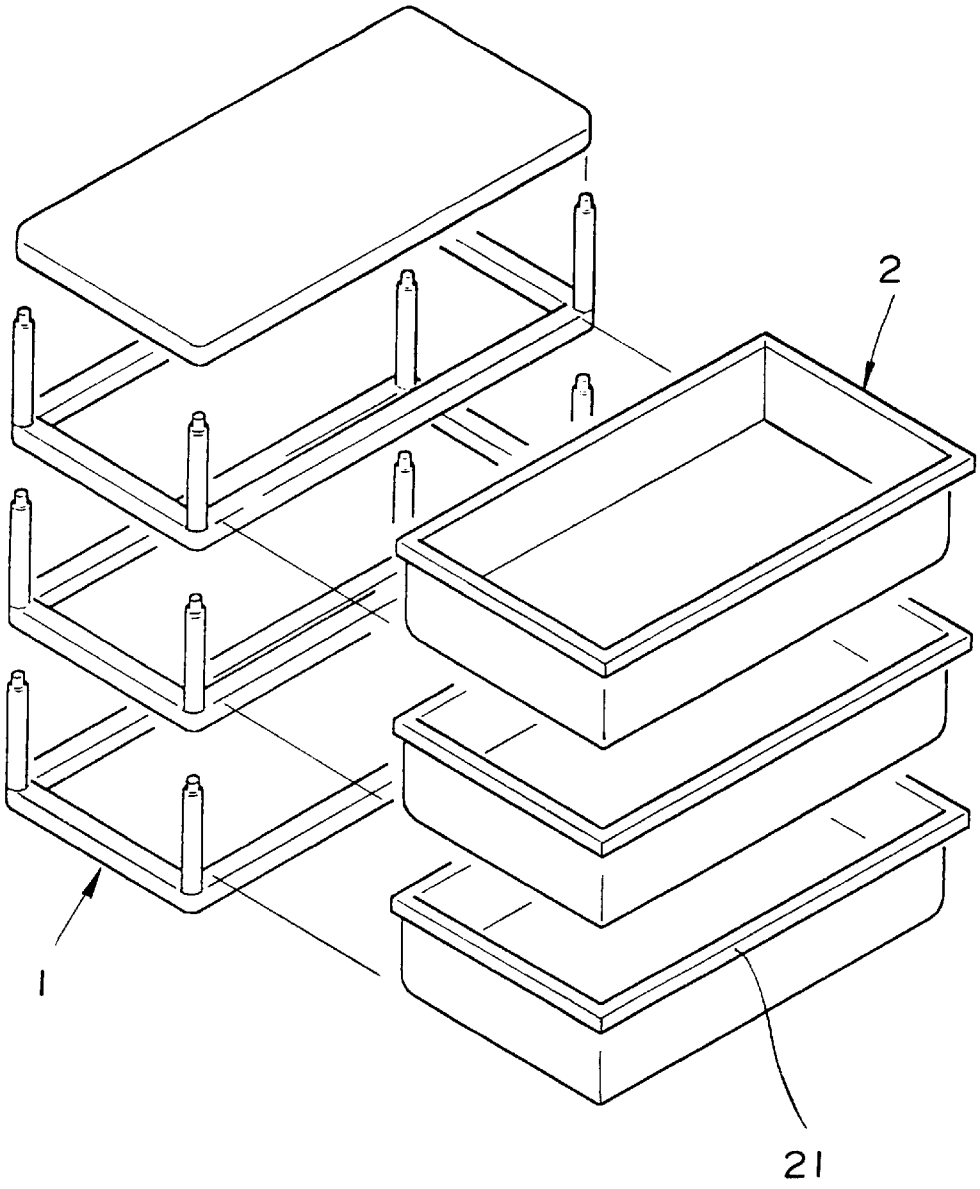
FIG. 1 (PRIOR ART)
FIG. 1 is a perspective view of a conventional drawer of a storage bin.
Figure 2:
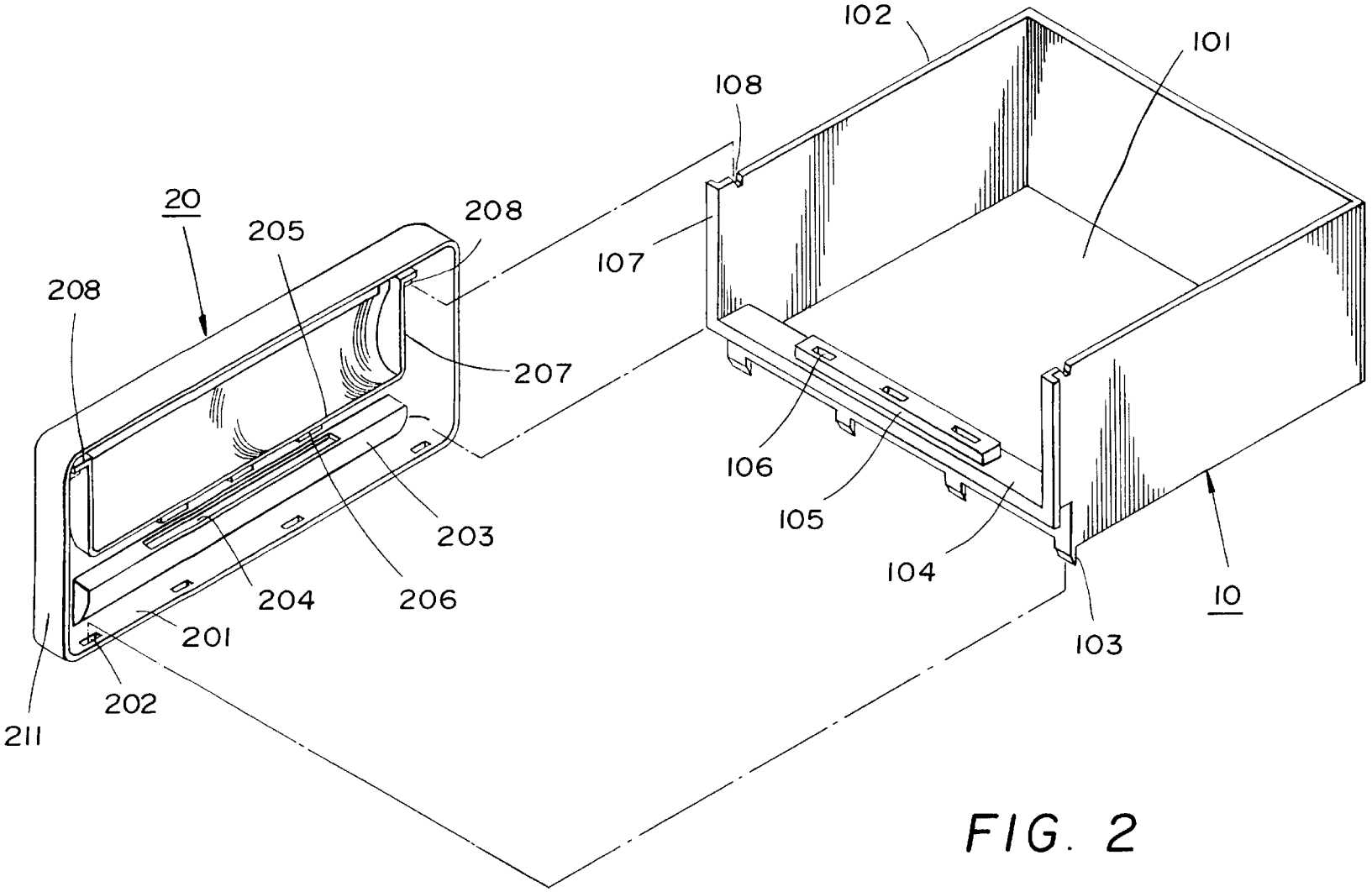
FIG. 2 is an exploded perspective view of the present invention.
Figure 3:
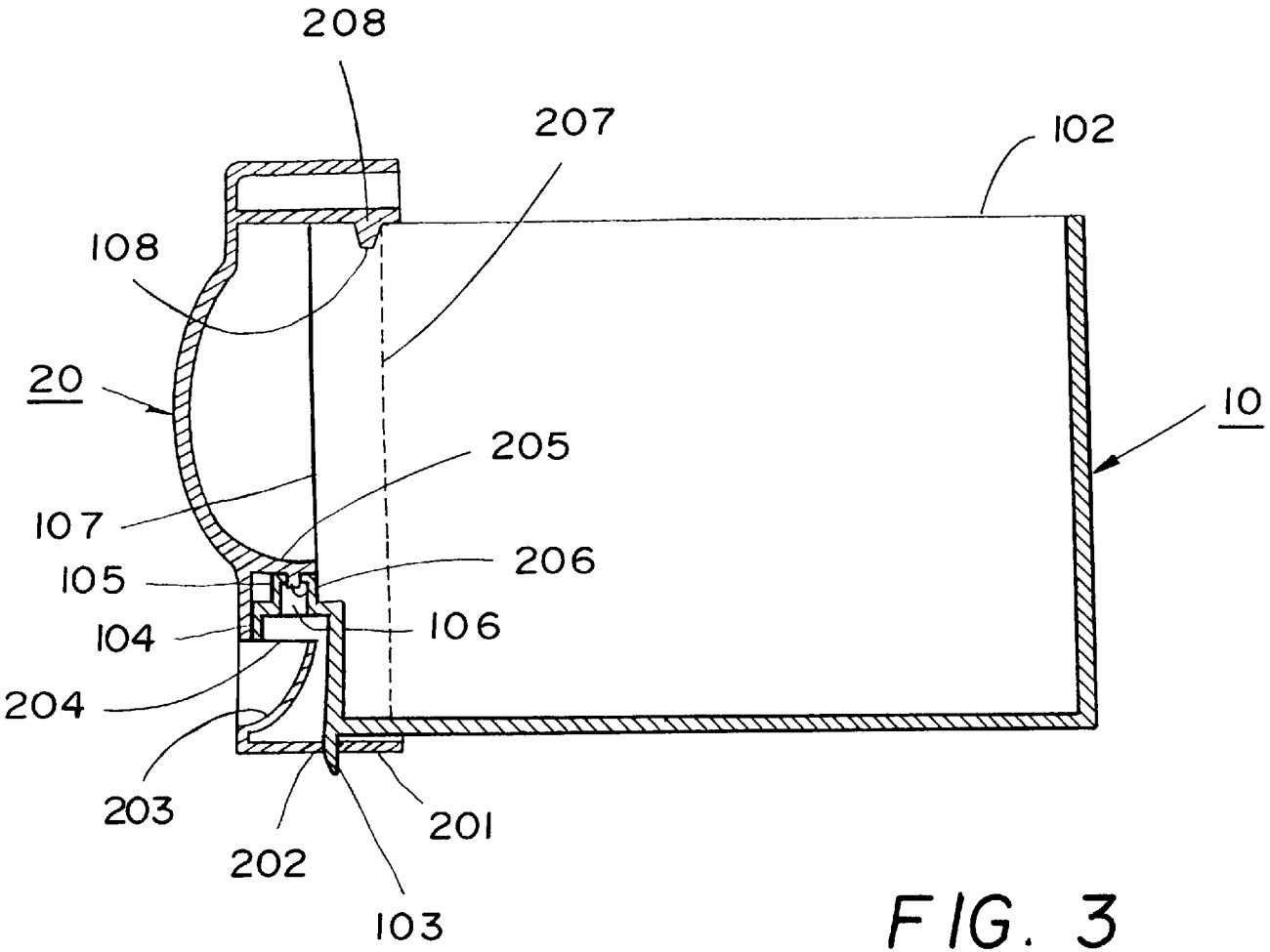
FIG. 3 is a sectional view of the present invention after assembling.

It can be seen from FIGS. 2 and 3 that, the drawer combination of a storage bin of the present invention is comprised of an injection moulded container 10 and an injection moulded front panel 20, wherein:

The container 10 is provided with a horizontal bottom plate 101, two vertical lateral plates 102 and a rear vertical stop plate; the front thereof is opened, the bottom plate 101 is provided with a plurality of engaging pieces 103 beneath the front edge thereof and extending downwardly and spacing mutually, the front edge is provided thereon with a gripping edge 104 which is recessed on the bottom thereof and forms a protruding grip 105 on the top, and the top of the protruding grip 105 is provided with a plurality of engaging holes 106; the two lateral plates 102 extend forwardly respectively to form two connecting edges 107 which both join the gripping edge 104 on the bottom ends thereof and are provided each with an engaging groove 108 on the top ends thereof.

The front panel 20 is made in the shape of a sheet, can be assembled on the front side of the container 10 and is provided with four edges, including a bottom edge 201 and a pair of side edges 211. The bottom edge 201 is provided with a plurality of inwardly positioned engaging holes 202 corresponding respectively to the engaging pieces 103 of the container 10, the front panel 20 is provided further with a recess chamber 203 above the bottom edge 201, the front panel 20 is therefore convex, the recess chamber 203 is located exactly beneath the gripping edge 104 after assembling of the front panel 20 with the container 10, an opening 204 is provided in the recess chamber 203 at the postition corresponding to the grip 105 of the gripping edge 104, when a user extends his hand into the recess chamber 203 of the front panel 20, he can hold the grip 105 through the opening 204 in the recess chamber 203; an engaging edge 205 is provided above the recess chamber 203 of the front panel 20, which engaging edge 205 is located exactly above the grip 105 after assembling, a plurality of locking hooks 206 are provided thereon corresponding respectively to the engaging holes 106 on the top of the grip 105, the engaging edge 205 is provided on each end thereof with an abutting edge 207 extending upwardly therefrom, the abutting edge 207 can abut against the connecting edges 107 in the front of the container 10, the tops of the abutting edges 207 are provided each with an engaging hook 208 corresponding respectively to an abovementioned engaging groove 108, so that the engaging hooks 208 can be engaged in the engaging grooves 108.

By providing the above stated structure, when the front panel 20 is connected to the container 10, at the lower position, the engaging holes 202 on the bottom edge 201 of the front panel 20 are engaged by the engaging pieces 103 on the bottom plate 101 of the container 10, the locking hooks 206 on the engaging edge 205 of the front panel 20 are engaged in the engaging holes 106 on the top of the grip 105 of the container 10; at the upper position, the engaging hooks 208 of the front panel 20 are engaged in the engaging grooves 108 of the container 10, so that an object of mutual connection can be attained; further, at the lateral side positions, the abutting edges 207 of the front panel 20 abut against the connecting edges 107 of the container 10 to increase stability, so that firmness of the drawer can be obtained.

When in assembling of the above stated structure, just exert a force on the front panel 20 against the container 10, connection of the two can be completed, such assembling is extremely convenient. Moreover, when in use, a user extends his hand into the recess chamber 203 of the front panel 20 and hold the grip 105 of the container 10 through the opening 204 in the recess chamber 203, not only the grip 105 bears the force, the force can be distributed through the engaging structure to the whole front edge of the container 10, thereby the grip is not subjected to damage, and the life of use thereof can be increased.

In conclusion, the drawer combination of a storage bin of the present invention is structurally novel, it can increase convenience of assembling as well as firmness. Having now particularly described and ascertained the technical structure, I claim:

1. A drawer assembly for a storage bin, the assembly comprising:

a) an injection molded container having an open front side and an injection front panel engageable with the front side of the container to form the drawer assembly;

b) the container including a bottom plate, a pair of spaced lateral plates, each of the bottom and lateral plates including a front edge, the front edge of the bottom plate further including a plurality of spaced downwardly extending engaging pieces, a top portion having a gripping edge with a bottom recess, a protruding grip on the top portion having a plurality of spaced engaging holes, and an engaging groove formed in an upper edge of each of the lateral plates adjacent the front edge thereof; and c) the front panel having four rearwardly extending edges, including a bottom edge, the bottom edge further including a plurality of spaced engaging holes for engagement by the engaging pieces of the container, a recess chamber positioned above the bottom edge, the recess chamber being disposable below the gripping edge of the container and including a top opening for receiving the hand of a user, an engaging edge positioned above the recess chamber and disposable above the protruding grip of the container, a plurality of spaced locking hooks extending downwardly from the engaging edge for engagement with the engaging holes of the protruding grip, the engaging edge further including a pair of spaced upwardly extending abutting edges, the abutting edges being engageable against the front edges of the lateral plates, each of the abutting edges including an engaging hook positioned at a top portion thereof, and the engaging hooks being engageable with the engaging grooves of the lateral plates.

* * * * *